US005111851A

United States Patent [19]

Takegawa

[11] Patent Number: 5,111,851

[45] Date of Patent: May 12, 1992

[54] METHOD OF RESTORING A BROKEN WARP AFTER MENDING THE SAME

[75] Inventor: Yujiro Takegawa, Kahoku, Japan

[73] Assignee: Tsudakoma Corp., Ishikawa, Japan

[21] Appl. No.: 675,971

[22] Filed: Mar. 28, 1991

[30] Foreign Application Priority Data

Mar. 28, 1990 [JP] Japan ..... 2-80228
Apr. 27, 1990 [JP] Japan ..... 2-113471

[51] Int. Cl.[5] ..... D03J 1/14; D03D 23/00

[52] U.S. Cl. ..... 139/1 R; 139/35; 139/192; 28/209; 28/211

[58] Field of Search ..... 139/192, 1 R, 35, 351, 139/353, 291 C; 28/211, 209

[56] References Cited

U.S. PATENT DOCUMENTS 4,805,276 2/1989 Plaschy ..... 28/211 X
4,817,675 4/1989 Dewaele et al. ..... 28/209 X
4,898,213 2/1990 Takegawa .
4,967,801 11/1990 Gryson ..... 139/351 X
4,998,566 3/1991 Akiyama ..... 139/35
5,050,643 9/1991 Takegawa et al. ..... 139/35 X

FOREIGN PATENT DOCUMENTS 62-69851 3/1987 Japan .
63-28951 2/1988 Japan .
1-174649 7/1989 Japan .
1-192853 8/1989 Japan .

*Primary Examiner*—Andrew M. Falik
*Attorney, Agent, or Firm*—Wenderoth, Lind & Ponack

[57] ABSTRACT

When a warp is broken during weaving on a loom, the broken warp is mended and restored by a method of restoring a broken warp after mending the same, comprising steps of connecting a mending yarn to the trailing portion of the broken warp to form a mended warp; cutting a normal warp which has been drawn through the same slit between dents as the broken warp is to be drawn through and inserting a mending yarn with a sufficient length between the cut ends of the normal warp, tying the mending yarn connected to the trailing portion of the broken warp to the normal warp drawn through the same slit between the dents as the broken warp is to be drawn through; and pulling the normal warp toward the take-up side so that the mended warp and the normal warp are tightened properly. Thus, the mended warp is drawn through the slit between the dents together with the normal warp.

6 Claims, 12 Drawing Sheets

METHOD OF RESTORING A BROKEN WARP AFTER MENDING THE SAME

BACKGROUND OF THE INVENTION

1. Field of the Invention

The present invention relates to a method of restoring a broken warp after mending the same, by which a broken warp is mended and drawn through the heddle and reed of the loom before restarting the loom.

2. Description of the Prior Art

A warp broken during the weaving operation must be mended. In mending the broken warp, a mending yarn is connected to the trailing portion of the broken warp extending from the warp beam, and then the mending yarn is drawn through a correct slit between the adjacent dents of the reed. Naturally, if the broken warp has dropped off the drop wire or the heddle, the mending yarn must be drawn through the drop wire or the heddle. In any case, the mending yarn must be drawn through the reed in mending the broken warp.

Generally, the needle of a reeding machine is used for drawing the mending yarn through the reed. Accordingly, the needle must be located accurately opposite to the correct dent. However, wrong reeding is liable to occur due to the advancement of the needle in a incorrect direction or to the interference of the warps with the needle even if the needle is located accurately, and hence the probability of successful reeding is low.

According to a method of the present invention, described later, and a method of mending the warp as disclosed in Japanese Patent Laid-Open Publication No. 1-192853, the mending yarn can be connected to the broken warp on the cloth fell side. However in this situation, the mended warp can not be extracted from the regular warps to be positioned adjacent to each other if the mended warp is drawn through the warps positioned in front of the dents. As a result, if the weaving operation is restarted while a predetermined tension is given to the wrong drawn warp, it is possible to form a defect in the woven fabric and the warp is liable to be broken.

SUMMARY OF THE INVENTION

Accordingly, it is an object of the present invention to achieve the drawing of a mending yarn through the reed with accuracy without using any drawing means, such as a needle.

Another object of the present invention is to minimize a defect formed in the fabric due to the breakage of a warp even if the mended warp is not removed, by surely drawing the mended warp connected to a mending yarn through the reed, maintaining the mended warp at a correct position relative to the adjacent warps and properly tightening the mended warp.

In order to achieve the first object according to the present invention, assuming that two warps are drawn through each slit between the adjacent dents of the reed and one of the two warps is broken, a mending yarn is connected to the broken warp on the let-off side, the normal warp, i.e., the other warp not broken, is cut and both the cut ends thereof are connected by a mending yarn of a sufficient length, the normal warp is slackened sufficiently and connected to the normal warp, the mending yarn connected to the broken warp is connected to the normal warp, and the thus slackened normal warp is pulled toward the front, namely, toward the side of the cloth fell to draw the broken warp and the normal slackened warp together through the correct slit between the adjacent dents of the reed.

According to a first aspect of the invention, a broken warp is connected to an intentionally slackened normal warp passing through the same slit of the reed that the broken warp is drawn through by a mending yarn, and the broken warp is guided by the slackened normal warp in drawing the broken warp through the slit. Accordingly, the broken warp can surely be drawn through the correct slit without using any needle such as used by the conventional reeding machine or any complicated locating device for locating a needle.

According to a second aspect of the invention to achieve the second object, a mended warp connected to a cloth fell through a mending yarn is extracted at a position between the heddle and the reed, the mended warp is displaced vertically, the vertically displaced mended warp is caught at a position in front of the reed, and the loom is started while the mended warp is pulled in the take-up direction to tighten the same properly.

When the mended warp is extracted at a position between the heddle and the reed and is displaced vertically, the mended warp is extracted from the adjacent normal warps. Hence, the mended warp can be caught with ease at a position in front of the reed without disturbing the arrangement of the warps. Since the mended warp is tightened properly in front of the reed, the correct disposition of the mended warp relative to the arrangement of the normal warps is maintained, so that the mended warp recovers the normal weaving state immediately.

BRIEF DESCRIPTION OF THE DRAWINGS

FIGS. 1 to 20 relate to a first embodiment corresponding to both the first and second inventions; and FIGS. 21 to 28 relate to a second embodiment corresponding to the second invention.

DETAILED DESCRIPTION OF THE INVENTION

First Embodiment

FIGS. 1 to 11 show a series of steps of a method of restoring a broken warp after mending the same in a first embodiment.

Figure 1:
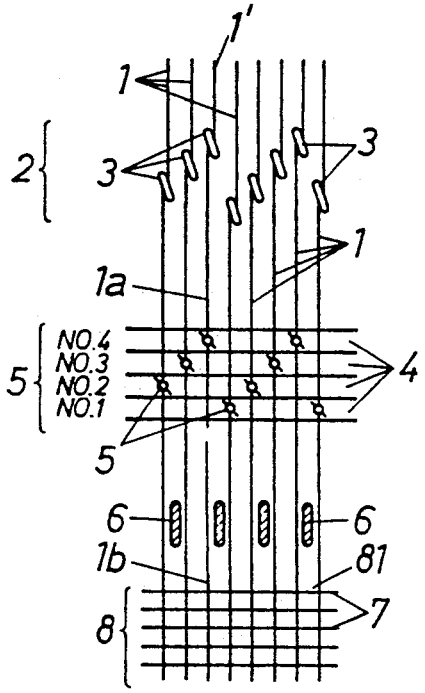
FIGS. 1 to 11 are diagrammatic views for assisting in explaining a warp mending procedure FIGS. 1–5, 8, and 10 being plan views, and FIGS. 6, 7, 9 and 11 being side views.

When one warp among a plurality of warps 1 is broken (the broken warp will be hereinafter referred to as 1' when being referred to individually) at a position between a heddle 5 and a reed 6 into a trailing portion 1*a* and a leading portion 1*b* as shown in FIG. 1, a drop wire 3 suspended on the broken warp 1' drops to give a warp breakage signal to a warp stop motion detector 2, and then the warp stop motion detector 2 provides a warp stop signal to stop the loom automatically at a predetermined angular stopping position. Then, all heddle frames 4 are leveled with each other so that the shed is closed and all the warps 1 are leveled with the warp line. The warps 1 are arranged in a sheet, are drawn respectively through the heddles 5 of, for example, the four heddle frames 4 in a predetermined periodic sequence, and are drawn through the reed. Two warps 1, for instance, are drawn through each of the slits between the dents 6 of the reed. The warps 1 are interlaced with wefts 7 at a cloth fell 81 to weave the fabric 8. The two warps 1 drawn through the same slit between the dents 6 have a fixed relation with each other in respect of the frame numbers of the heddle frames 4 respectively for operating the two warps 1.

Then, the normal warps 1 are separated from the broken warp 1' by reciprocating the dropped drop wire 3 laterally, i.e., widthwise of the loom, by a yarn separating device, not shown, such as disclosed in Japanese Patent Laid-Open Publication No. 62-69851 or by twisting the dropped drop wire 3 by a yarn separating device disclosed in Japanese Patent Laid-Open Publication No. 63-28951.

Figure 2:
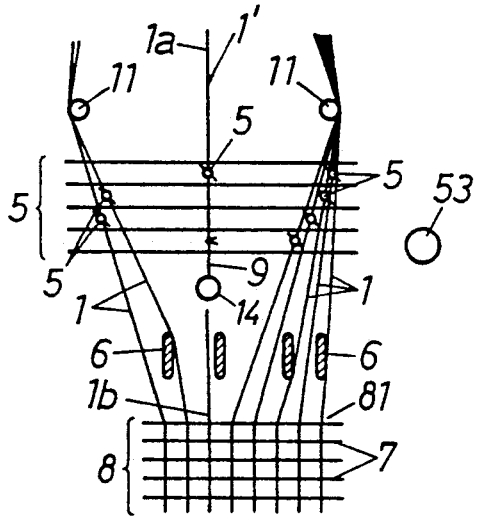

Subsequently, as shown in FIG. 2, a pair of yarn separating members 11 are inserted from below the warps in small slits on the opposite sides of the broken warp 1' near the array of drop wires 3, are moved laterally respectively in opposite directions to separate the other warps 1 from the broken warp 1', and are moved to near the heddle frames 4 so that the broken warp 1' is separated from the other warps 1 to facilitate extracting the broken warp 1'. The yarn separating members 11 are such as included in a yarn separating device disclosed in Japanese Patent Laid-Open Publication No. 1-192853, in which the yarn separating members 11 are moved vertically by a pneumatic actuator or the like, are attached to belts or the like, and are moved laterally by a pneumatic actuator or the like to separate the normal yarns from the broken yarn. Then, a mending yarn 9 is connected to the trailing portion 1*a* of the broken warp 1' by a bonding or mechanical knotter 53, and the mending yarn 9 is held by a suction holder 14 at a position behind the reed 6.

Figure 3:
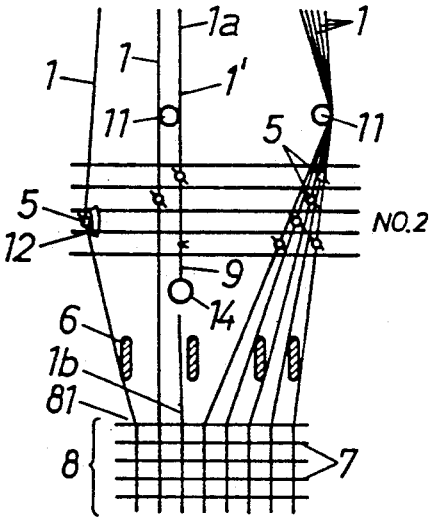

Then, a controller, not shown, identifies the heddle frame 4 corresponding to the broken warp 1' for example, the heddle frame No. 4, by a method to be described later and then determines on the basis of the frame number, e.g., No. 4, of the heddle frame 4 and on the basis of the reeding sequence whether the warp 1 which is drawn through the same slit between the dents 6 that the broken warp 1' is drawn through is the next one to the left of the broken warp 1'. The controller further identifies the heddle frame 4, e.g. the heddle frame No. 2 in this case, corresponding to the warp 1 which is two warps to the left of the broken warp 1', moves a yarn separating member 12 laterally according to a signal indicating the position of the dropped drop wire 3 from its standby position to a position near the broken warp 1', and then moves the yarn separating member 12 along the direction of extension of the warps 1 to a position near the heddle frame No.2 as shown in FIG. 3 to restrain the heddle 5 of the heddle frame No. 2 against movement. Then, the yarn separating member 11 on the left-hand side of the broken warp 1' is moved laterally toward the broken warp 1' to extend the broken warp 1' and the warp 1 drawn together with the broken warp 1' through the same slit between the side by side dents 6 as shown in FIG. 3.

Figure 4:
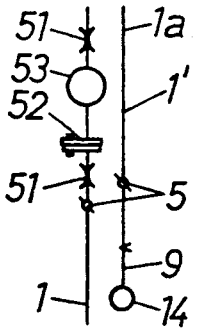
Figure 5:
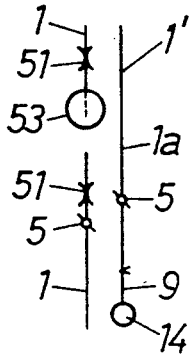
Figure 6:
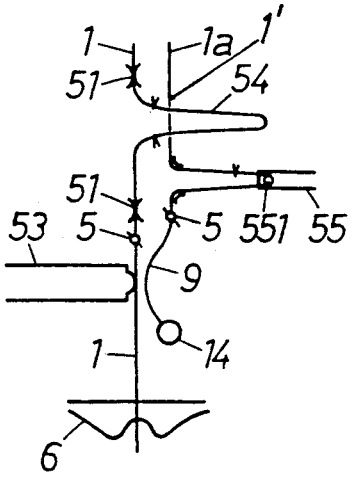

Then, as shown in FIG. 4, the normal warp 1 drawn through the same slit between the dents 6 that the broken warp 1' is drawn through is gripped by two grippers 51 which have previously been moved to near the broken warp 1', and the thus gripped warp 1 is cut by a cutter 52 at a position between the grippers 51. Then a mending yarn 54 of a sufficient length is connected adhesively or mechanically to the cut ends of the cut warp by the knotter 53, thereby forming slack in the thus mended warp, as shown in FIGS. 5 and 6. Subsequently, a pulling member 55 having a pin 551 approaches the trailing portion 1*a* of the broken warp 1 from above the same in a region between the warp stop motion detector 2 and the heddle frames 4, the pin 551 engages the trailing portion 1*a* of the broken warp 1, and then the pulling member 55 moves downward. Consequently, the mending yarn 9 held by the suction holder 14 is pulled out from the suction holder 14 to the extent necessary to form an amount of slack substantially equal to that of the mending yarn 54. A method of feeding the mending yarns 9 and 54 will be described afterward later.

Figure 7:
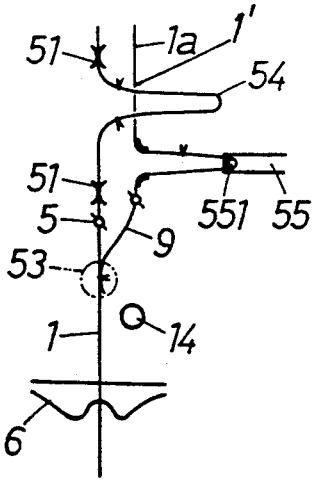

Subsequently, as shown in FIG. 7, the knotter 53 is moved near to the suction holder 14 and fastens the free end of the mending yarn 9 adhesively or mechanically to the slackened normal warp 1 which is drawn through the same slit between the dents 6 that the broken warp 1 is drawn through in a region between the heddle 5 and the dents 6.

Figure 8:
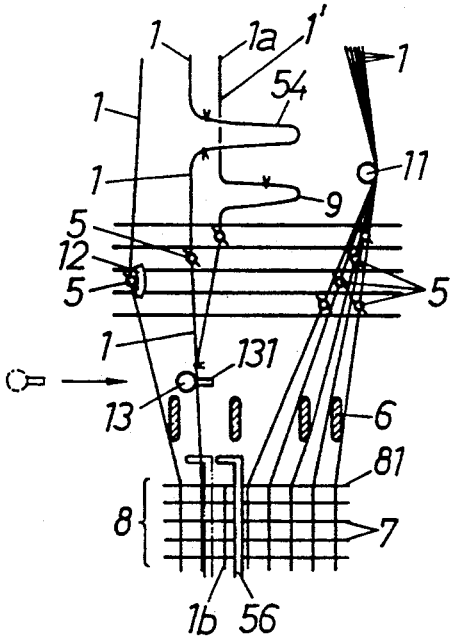

Although the normal warp 1 may be drawn through warps in front of the reed as disclosed in Japanese Patent Laid-Open Publication No. 1-192853, there is described hereafter the method in accordance with the second aspect of the invention. As shown in FIG. 8, the pulling member 55 releases the mending yarn 9 and, subsequently, a lifting member 13 having a pin 131 is moved from its standby position to near the broken warp 1' and with the pin 131, raises the warp 1 which is drawn through the same slit between the dents 6 that the broken warp 1' is drawn through as well as the mending yarn 9 connected to the broken warp 1 to a position above the other warps 1 behind the dents 6 as shown in FIG. 9.

Figure 9:
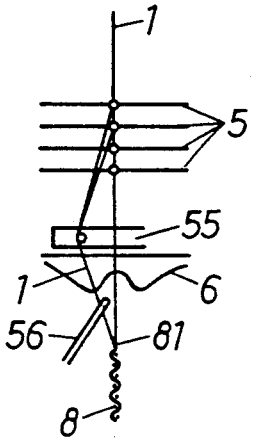
Figure 10:
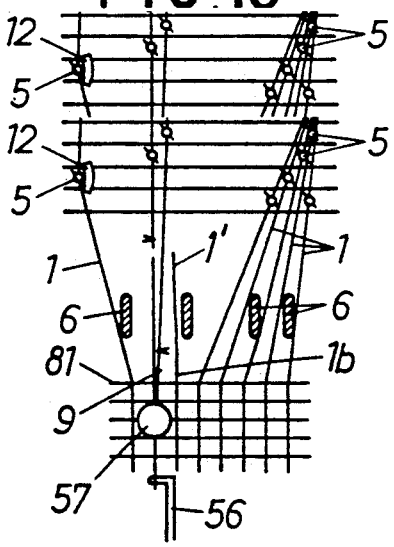

Then, as shown in FIGS. 8, 9 and 10, a hooking member 56 moves in front of the dents 6 along the cloth fell 81 in a slit between the dents 6 and the cloth fell 81 to hook the raised warp 1 in a raised position, and then moves in the take-up direction (i.e. away from the slackened portion) to remove the slack in the mending yarns 9 and 54 behind the dents 6. In this state, a suction member 57 accompanied by a hooking members 56 is operated to suck the mending yarns 9 and 54 together with air by suction so that the trailing portion 1*a* of the broken warp 1' and the warp 1 connected respectively to the mending yarns 9 and 54 are tightened properly while the warp is removed from the hooking members 56 and a lifting member 13 and the suction holder 14 is returned to the original waiting position. Thus, the trailing portion 1*a* of the broken warp 1′ is drawn through the slit between the dents 6 together with the normal warp 1 extending through the same slit between the dents 6 that the broken warp 1 is drawn through. Then, the loom can be restarted.

Figure 11:
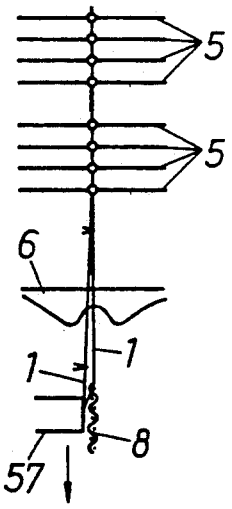

As the weaving operation is continued after the loom has been restarted, the suction member 57 and the mending yarns 9 and 54 move toward the take-up side as shown in FIG. 11. Eventually, the suction member 57 stops, and then the mending yarns 9 and 54 are pulled out gradually from the suction member 57 and are woven into the fabric 8 as the weaving operation is continued. The warps which were not woven into the fabric 8 is taken up while it are protruded from the fabric 8 but they can be removed with use of a cutting device attached to a suction pipe as disclosed in U.S. Pat. No. 4,898,213.

In this embodiment, the normal warp 1 drawn through the same slit between the dents 6 that broken warp 1′ is drawn through is cut in a region between the drop wire 3 of the warp stop motion detector 2 and the heddle frame 4 to connect the mending yarn 54 to the cut normal warp 1. However, it is also possible to cut the normal warp 1 at a position between the heddle frame 4 and the dents 6 to connect the mending yarn 54 to the cut normal warp 1. It is important that the connected portions of the mending yarn 9 and the other mending yarn 54 are positioned in front of the cloth fell when the normal warp 1 is drawn into the cloth fell side. If the warp 1 is broken at a position between the warp beam and the heddle 5, the mending yarn 9 is connected to the trailing portion 1*a* of the broken warp 1′ by the knotter 53, the leading portion 1*b* of the broken warp 1′ is removed from the heddle 5 and the drop wire 3 by a method which will be described later, the mending yarn 9 is threaded automatically or manually through the corresponding heddle 5 and the drop wire 3, and then the broken warp mending procedure in the foregoing embodiment is carried out.

The foregoing functional members will be described concretely hereinafter.

Figure 12:
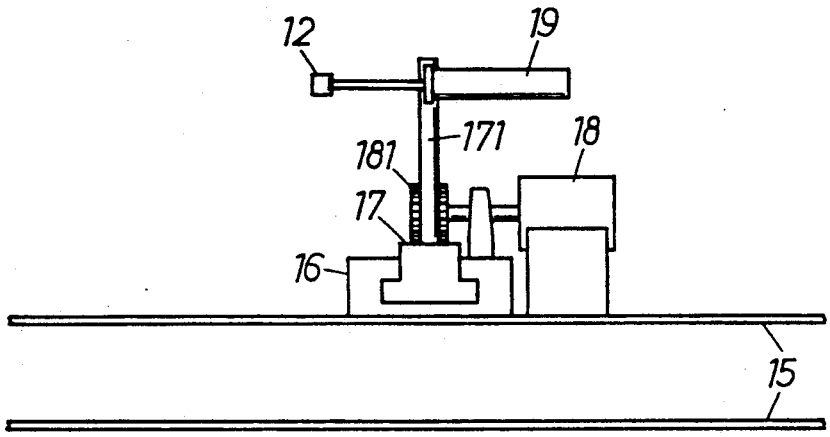
FIGS. 12 to 14 are side views of a mechanical driving unit.

Referring to FIG. 12, the yarn separating member 12 is moved laterally together with a guide 16 by an endless belt 15. The yarn separating member 12 is supported on a sliding rack 17 engaging a pinion 181 mounted on the output shaft of a motor 18. The motor 18 drives the sliding rack 17 for sliding movement along the warp 1. After the sliding rack 17 has reached a desired position, a pneumatic actuator 19 held on a bracket 171 attached to the sliding rack 17 is actuated to make the yarn separating member 12 engage a desired heddle 5.

Figure 13:
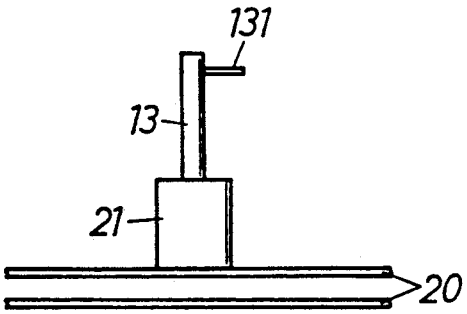

As shown in FIG. 13, the lifting member 13 is moved laterally by a belt 20. The lifting member 13 is raised by a predetermined distance by a solenoid 21 disposed with its axis in a vertical position.

Figure 14:
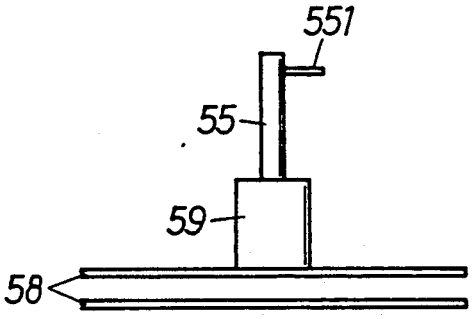

As shown in FIG. 14, the pulling member 55 is moved laterally by a belt 58. The pulling member 55 is raised by a desired distance by a solenoid 59 disposed with its axis in a vertical position.

Figure 15:
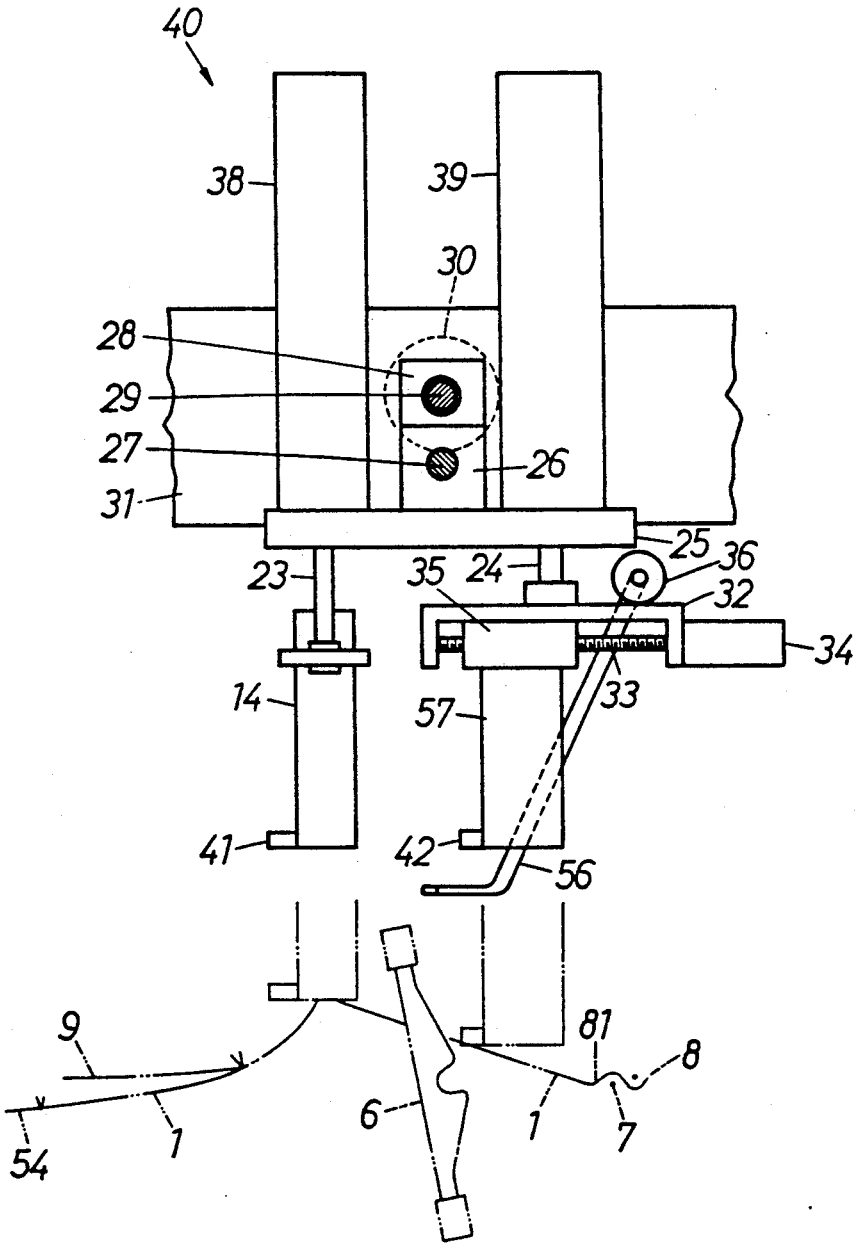
FIGS. 15 and 16 are front views of other driving units.

As shown in FIG. 15, the suction holder 14, the hooking member 56 and the suction member 57 are mounted on a carriage 40 so as to move together with the carriage 40 above the dents 6. The suction member 14 and the suction member 57 are fastened to the respective piston rods 23 and 24 of pneumatic actuators 38 and 39 fastened to a slider 26 via a bracket 25 in a vertical position so as to project the piston rods 23 and 24 downward, respectively. The slider 26 is provided integrally with an internally threaded block 28. The slider 26 is supported for lateral sliding movement on a guide rod 27. The internally threaded block 28 is in engagement with a screw rod 29 parallel to the guide rod 27. The screw rod 29 is journaled on a pair of frames 31 provided on the opposite sides of the loom and is driven for rotation by a motor 30. A horizontal screw rod 33 is journaled in parallel to the warps 1 on a support member 32 attached to the lower end of the piston rod 24. The screw rod 33 is driven for rotation by a motor 34. The screw rod 33 is in engagement with an internally threaded block 35 fastened to the suction member 57 to move the suction member 57 in directions parallel to the warps 1. The suction holder 14 and the suction member 57 are provided respectively with yarn sensors 41 and 42 for detecting the suction of the warps 1. The hooking member 56 is turned by a rotary solenoid 36 attached to the support member 32 to pull the normal warp 1 and the mending yarns 9 and 54 toward the take-up side.

Figure 16:
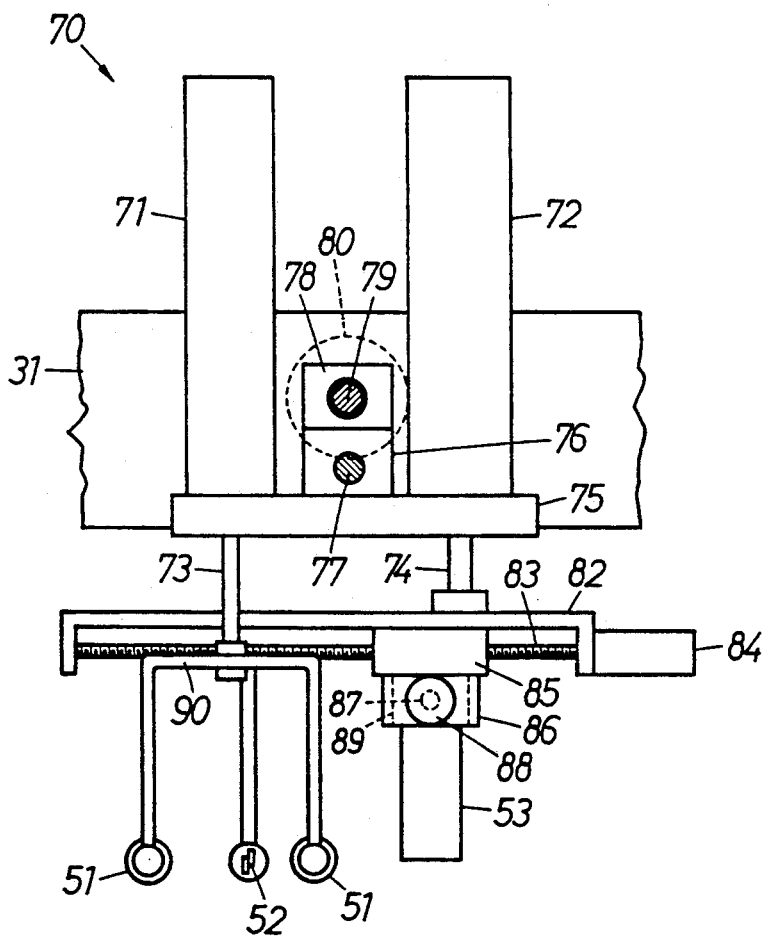

The grippers 51, the cutter 52 and the knotter 53 are moved by a moving mechanism 70 shown in FIG. 16. Pneumatic actuators 71 and 72 are held above the heddle frames 4 in a vertical position on a bracket 75 so as to project their piston rods 73 and 74 downward. A slider 76 attached to the bracket 75 is supported for lateral sliding movement on a guide rod 77. An internally threaded block 78 fastened to the slider 76 engages a screw rod 79 journaled on the pair of frames 31. The screw rod 79 is rotated to move the internally threaded block 78, hence the bracket 75, widthwise of the loom. A support member 82 of a predetermined length is attached to the lower end of the piston rod 74 of the pneumatic actuator 72 so as to extend in parallel to the warps 1, and a horizontal screw rod 83 is journaled on the support member 82. An internally threaded block 85 engages the screw rod 83. A motor 84 drives the screw rod 83 for rotation to move the internally threaded block 85 along the support member 82. An internally threaded block 89 engages a screw rod 87 journaled on a support member 86 fastened to the internally threaded block 85. The screw rod 87 is rotated by a motor 88 to move the internally threaded block 85 laterally. The knotter 53 is attached to the internally threaded block 85. Thus the knotter 53 can be moved laterally and longitudinally to a desired position. The knotter 53 sucks in two yarns ends to be pieced together through a suction opening and pieces the two yarn ends together. The two grippers 51 and the cutter 52 are held by a holder 90 attached to the lower end of the piston rod 73 of the pneumatic actuator 71. The grippers 51 and the cutter 52 are operated electromagnetically.

A detecting device 100 for detecting the normal warp 1 drawn through the same slit between the dents 6 that the broken warp 1′ is drawn through will be described hereinafter.

Figure 17:
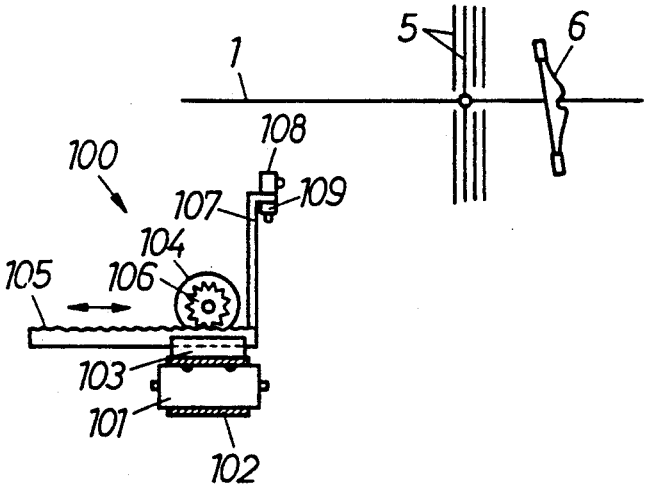
FIG. 17 is a side view of a detector.
Figure 18:
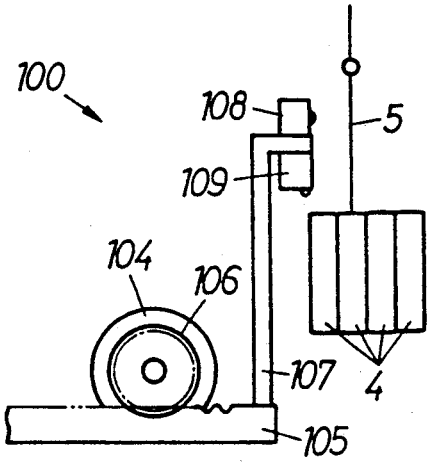
FIG. 18 is an enlarged side view of an essential portion of the detector.
Figure 19:
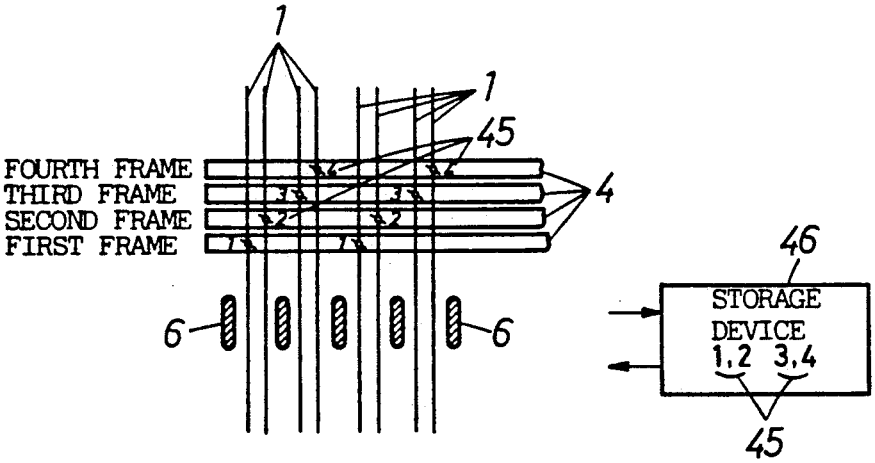
FIG. 19 is a plan view showing the numbering of heddle frames.

Referring to FIGS. 17 and 18, the detecting device 100 is supported for lateral movement on an endless belt 102 extended between a pair of pulleys 101 which are driven by a motor, not shown. The detecting device 100 has a guide member 103 attached to the endless belt 102, a rack 105 slidably supported for sliding movement along the warp 1 on the guide member 103, a pinion 106 engaging the rack 105 and mounted on the output shaft of a motor 104, a holder 107 attached to one end of the rack 105 in a vertical position, a horizontal sensor 108 attached to the upper end of the holder 107, and a vertical sensor 109 attached to the upper end of the holder 107. The horizontal sensor 108 detects the heddle 5 held on the heddle frame 4, and the vertical sensor 109 detects one specific heddle frame 4 among the plurality of heddle frames 4, four heddle frames 4 in this embodiment. As shown by way of example in FIG. 19, four successive warps 1 are drawn sequentially through the heddles 5 of the four heddle frames 4, respectively. This drawing mode is repeated to draw all the warps through the heddles 4 of the four heddle frames 4. The two successive warps 1 are drawn through the same slit between the dents 6 of the reed. The two warps 1 drawn through the same slit between the dents 6 have a fixed relation with each other in respect of the frame numbers of the corresponding heddle frames 4. Identification codes 45 corresponding to the frame numbers of the heddle frames 4, for identifying the heddles 5 are assigned to the heddles 5, respectively. The identification codes 45 of the two warp yarns 1 drawn through the same slit of the reed are stored in combination in a storage device 46 as shown in FIG. 19.

In detecting the frame number, the detecting device advances toward the broken warp 1' by a predetermined distance. Then, the motor 104 rotates the pinion 106 in the normal direction to advance the sensors 108 and 109 toward the heddle frames 4. Upon the detection of the heddle frame No. 1, by the sensor 109, the count of revolutions of the motor 104 is started. When the heddle 4 is detected by the sensor 108, the count is stopped and the number of the corresponding heddle frame 4 is found out by calculation on the basis of the revolutions of the motor 104. This calculation is carried out by a controller, not shown, in which the counted revolutions is divided by a constant corresponding to the revolutions of the motor 104 necessary for moving the detecting device 100 from one heddle frame to the next one. Thus the identification code of the heddle 5 through which the broken warp 1' is drawn is detected. Then, the controller determines the normal warp 1 drawn through the same slit as that the broken warp 1' is drawn through from the contents of the storage device 46 and the identification code 45 to determine locating conditions. Then, the motor 104 is rotated in the reverse direction to retract the sensors 108 and 109 and, if necessary, the detecting device 100 is moved laterally to its starting position by a motor, not shown.

It is also possible to find the normal warp 1 drawn through the same slit that the broken warp 1 is drawn through by a method disclosed in Japanese Patent Laid-Open Publication No. 1-174649, which assigns identification codes to all the drop wires 3 of the warp stop motion detector 2 and stores all the identification codes respectively in combination with the dents 6 to find out the normal warp 1 which is drawn through the same slit as the broken warp 1' is drawn through from the identification code of the drop wire 3 associated with the broken warp 1'.

The frame number of the heddle frame 4 may be detected by a device other than the foregoing detecting device 100. For example, the number of the heddle frame 4 supporting the dropped heddle 5 may be determined by a known warp stop motion detector which detects the breakage of a warp 1 through the detection of the drop of the heddle 5.

Figure 20:
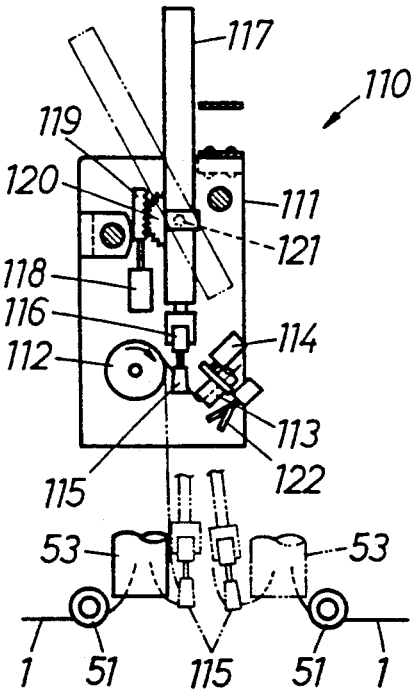
FIG. 20 is a side view of a yarn feed device.

The mending yarn 54 is fed by a yarn feed device 110 shown in FIG. 20. The yarn feed device 110 feed the mending yarn 54 to the knotter 53. The yarn feeds device 110 is provided with a bracket 111 which can be indexed with respect to lateral and longitudinal directions. A yarn package 112 for supplying the mending yarn 54 (9) is supported rotatably on the bracket 111. The mending yarn 54 (9) is held at the tip ends thereof within a suction holder 113 so as to extend across a path along which a gripper 115 moves. The suction holder 113 can be advanced or retracted by a pneumatic actuator 114. In feeding the mending yarn 54, the gripper 115 is driven by a solenoid 116 so as to grip the mending yarn 54, a pneumatic actuator 117 moves the gripper 115 to near the knotter 53 to place the free end of the mending yarn 54 near the suction opening of the knotter 53. Then, the knotter 53 sucks the respective free ends of the mending yarn 54 and the warp 1, and pieces together the mending yarn 54 and the warp 1. The knotter 53 may be a mechanical knotter such as disclosed in Japanese Patent Publication (Kokoku) No. 46-18301, a pneumatic knotter such as disclosed in Japanese Patent Publication (Kokoku) No. 53-43218 or a bonding knotter which joins together the yarns adhesively. Then, the gripper 115 is retracted to its standby position by the pneumatic actuator 117 while the knotter 53 is shifted from a position near the gripper 51 on the let-off side to a position near the gripper on the take-up side. Then, the suction holder 113 is advanced by the pneumatic actuator 114 to suck in the middle portion of the mending yarn 54 to extend the mending yarn 54 across the path of the gripper 115. The gripper 54 grips the mending yarn 54 again, and then a rack 119 is driven to turn the pneumatic actuator 117 on a horizontal shaft 121 through a pinion 120 engaging the rack 119 so that the gripper 115 is located at a mending yarn feed position. Then, the pneumatic actuator 117 is actuated to advance the gripper 115 to near the knotter 53 which has been moved previously to near the gripper 51 on the take-up side so that the mending yarn 54 is located near the suction opening of the knotter 53. Then, the cutter 122 cuts the middle portion of the mending yarn 54 to separate the portion of the mending yarn 54 connected to the warp 1 from the package 112. Then, the knotter 53 connects the mending yarn 54 to the free end of the normal warp 1 on the side of the cloth fell 81.

The mending yarn 9 is connected to the broken warp 1' by the same procedure after being connected to the broken warp 1'. The mending yarn 9 is cut in an appropriate length and is tied to the normal warp 1 drawn through the same slit between the dents 6 that the broken warp 1' is drawn through.

Incidentally, in case the warp 1 is broken at a position between the warp beam and the heddle 5, the yarn feed device 110 is moved along the warps 1, and the same yarn feed procedure is carried out to feed the mending yarn 9. The gripper 115 can be moved between the heddle 5 and the dents 6 as well as between the two grippers 51.

According to the first embodiment, the pieced normal warps 1 are displaced upward by a pin 131 fixed to the lifting member 13 and liable to be extracted. The pieced normal warps 1 are caught in front of the dents by the hooking holder movable laterally and delivered to the suction pipe 57 so as to be tightened at a predetermined tension.

Second Embodiment

Although the warp 1 is mechanically caught and displaced according to the first embodiment as one procedure of the second invention, the warp 1 can be fluidly caught and displaced according to a second embodiment set forth hereunder.

Figure 21:
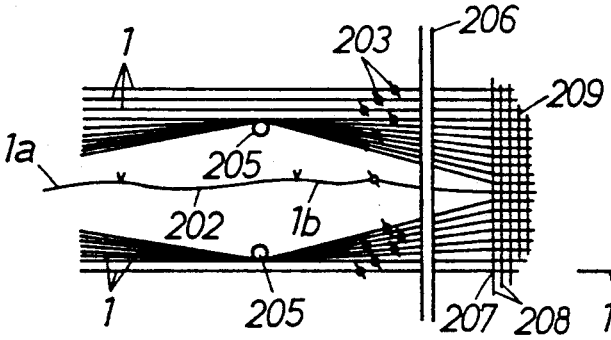
FIG. 21 is a plan view showing a mended warp.
Figure 22:
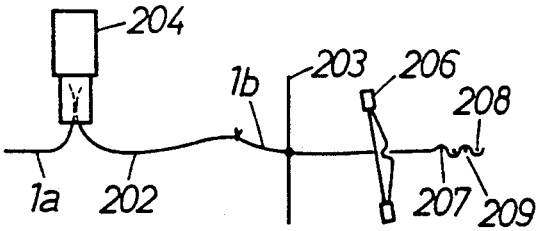
FIG. 22 is a side view showing a mended warp.

There is disclosed as the second embodiment warps 1*a* and 1*b* which are separated from the normal warps by a pair of separating member 205 and pieced together by a mending warp 202 as illustrated in FIGS. 21 and 22.

Figure 23:
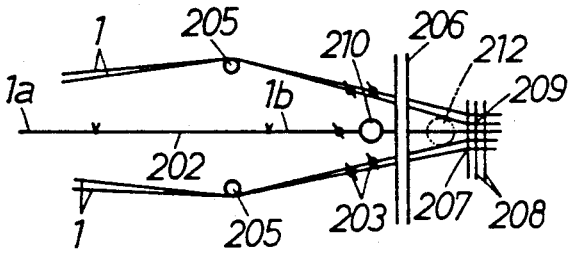
FIG. 23 is a plan view showing the positional relation between a yarn extractor and a yarn catcher.
Figure 24:
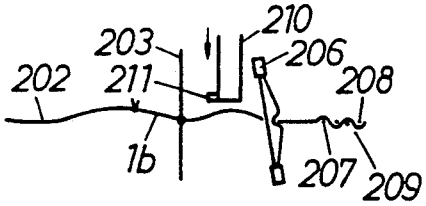
FIG. 24, 25 and 26 are side views for assisting in explaining a mended warp handling procedure.

Referring to FIGS. 23 and 24, a suction type yarn extractor 210 is moved from its standby position on one side of the loom to a position corresponding to the mended warp 1, i.e., the trailing portion 1*a* and leading portion 1*b* of the broken warp 1' and the mending yarn 202 connecting the trailing portion 1*a* and the leading portion 1*b*, on the basis of data indicating the position of the broken warp 1', and then the yarn extractor 210 starts suction as the same is lowered to suck in the mended warp 1 so that a slack of the mended warp 1 is removed. The extraction of the mended warp 1 by the yarn extractor 210 is detected by a yarn sensor 211 provided on the yarn extractor 210.

Figure 25:
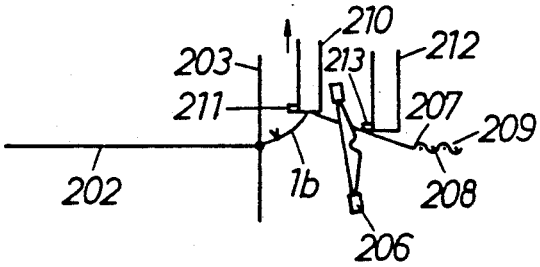

Then, as shown in FIG. 25, the yarn extractor 210 is raised to pull up the mended warp 1 so that the mended warp is tightened properly. Since the shed is closed in mending the broken warp 1', the leading portion 1*b* of the mended warp 1 extending in front of the dents 206 is separated from the normal warps 1 when the yarn extractor 210 is raised.

Figure 26:
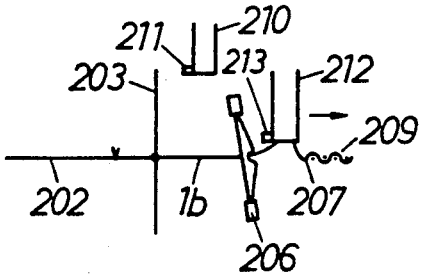

Subsequently, as shown in FIG. 26, a yarn catcher 212 of a suction type is moved from its standby position in front of the dents 206 to a position above the leading portion 1*b* of the mended warp 1, and then the yarn catcher 212 starts suction and the yarn extractor stops its suction. Consequently, the mended warp 1 is released from the yarn extractor 210 and is sucked into the yarn catcher 212. The yarn catcher 212 sucks the mended yarn so that a tension equal to a weaving tension is applied to the mended warp 1. A yarn sensor 213 detects the mended warp 1 when same is caught by the yarn catcher 212. Then, the yarn catcher 212 is moved toward the take-up side by a predetermined distance so that the yarn catcher 212 may not interfere with the beating-up motion. Meanwhile, the yarn extractor 210 is returned to its uppermost position so that the yarn extractor 210 may not interfere with the beating-up motion. The pair of yarn separating members 205 are lowered away from the warps 1 to their standby positions before restarting the loom. The mended warp 1 is controlled for shedding together with the normal warps 1.

After the tension acting on the mended warp 1 has been stabilized, a start command is given to restart the loom. The yarn catcher 212 is moved forward at a moving speed equal to that of the fabric 209 holding the mended warp 1 for a predetermined time or during a predetermined number of picking cycles after the loom has been restarted, and then the yarn catcher 212 stops its suction and is returned to its standby position. Then, a slack portion of the mended warp 1 is woven into the fabric 209 in a loop, and the mended warp 1 is woven normally into the fabric 209 after the formation of the loop.

Figure 27:
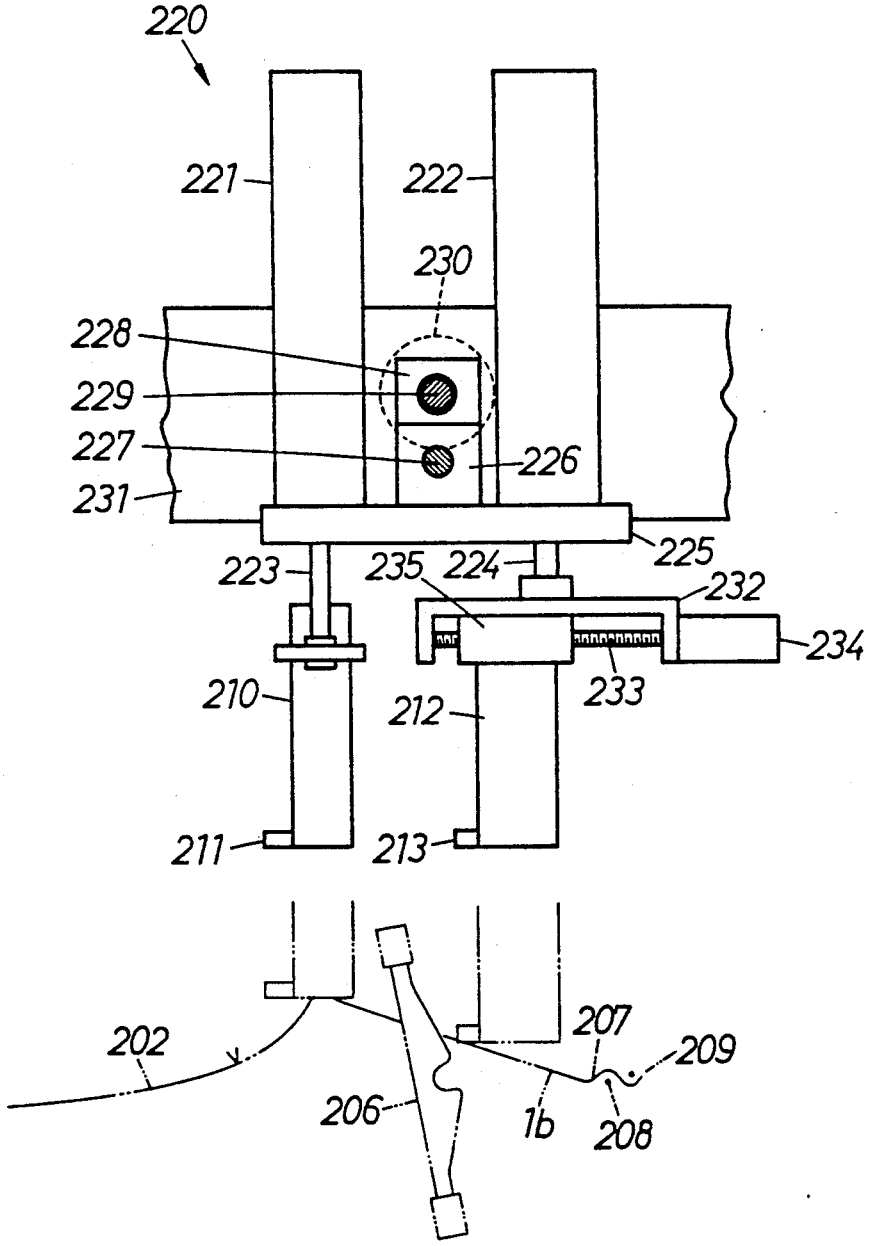
FIG. 27 is a side view showing a yarn extractor and a yarn catcher guide.

FIG. 27 shows a carrying device 220 for carrying the yarn extractor 210 and the yarn catcher 212.

Referring to FIG. 27, pneumatic actuators 221 and 222 are held on a bracket 225 in a vertical position so that their piston rods 223 and 224 are projected downward. A slider 226 fixed to the bracket 225 is supported for sliding movement on a guide rod 227. An internally threaded block 228 fastened to the slider 226 engages a screw rod 229 extending in parallel to the guide rod 227 and journaled on a pair of frames 231 provided respectively on the opposite sides of the loom. The screw rod 229 is rotated by a motor 230 to move the bracket 225 along the guide rod 227. The yarn extractor 210 is attached to the lower end of the piston rod 223 of the pneumatic 221. A support member 232 is attached to the lower end of the piston rod 224 of the pneumatic actuator 222, and a screw rod 233 is journaled on the support member 232. An internally threaded block 235 attached to the yarn catcher 212 engages the screw rod 233. The screw rod 233 is rotated by a motor 234 attached to the support member 232 to move the yarn catcher along the warps 1.

Figure 28:
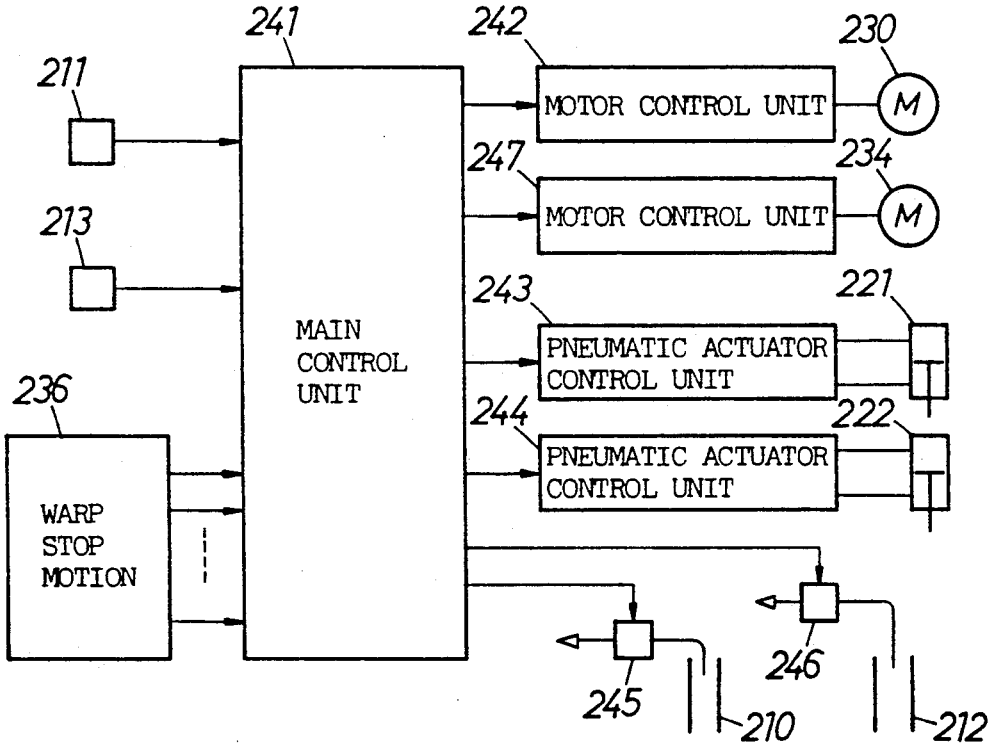
FIG. 28 is a block diagram of a program control system.

Referring to FIG. 28, a main control unit 241 storing a program of a procedure to be executed by the method of the present invention receives data representing the position of the broken warp 1' with respect to the width of the loom from a warp stop motion detector 236, gives commands indicating the direction of rotation and revolutions of the motor 230 to a motor control unit 242, and controls the pneumatic actuators 221 and 222 through pneumatic actuator control units 243 and 244. The main control unit 241 controls shut-off valves 245 and 246 on the basis of signals provided by the yarn sensors 211 and 213, and controls the rotating speed, direction of rotation and revolutions of the motor 234 through a motor control unit 247.

What is claimed is:

1. A method of restoring a broken warp after mending the same, comprising the steps of:

drawing a mending yarn connected to a trailing portion of the broken warp through a drop wire and a heddle supported on a heddle frame;

cutting a normal warp drawn through the same slit between adjacent dents of a reed as the trailing portion of the broken warp is to be drawn through, and connecting a mending yarn to the cut normal warp by inserting the mending yarn between the free ends of the cut normal warp;

connecting the mending yarn connected to the trailing portion of the broken warp to the normal warp drawn through the same slit between the adjacent dents of the reed as the trailing portion of the broken warp is to be drawn through, at a position between the heddle of the heddle frame and the dents between which the trailing portion of the broken warp is to be drawn; and drawing forward the normal warp drawn through the same slit between the adjacent dents of the reed as the trailing portion of the broken warp is to be drawn through in order to drawn the broken warp through the slit between the adjacent dents.

2. A method of restoring a broken warp after mending the same, comprising the steps of:

engaging a mended warp mended by connecting the trailing portion of a broken warp to a mending yarn at a position between a heddle and dents corresponding to the broken warp;

vertically separating the mended warp from normal warps and retaining the mended warp at a separated position relative to the normal warps;

catching the mended warp retained at the separated position at a position in front of the corresponding dents;

pulling the mended warp so that the mended warp is tightened; and restarting the loom with the mended warp tightened.

3. A method of restoring a broken warp after mending the same according to claims 1 or 2, wherein the mended warp is drawn through a slit between the dents by the suction of a suction means disposed in front of the dents.

4. A method of restoring a broken warp after mending the same according to claim 3, wherein the mended warp is moved together with a fabric being woven as the weaving operation progresses.

5. A method of restoring a broken warp after mending the same according to claims 1 or 2, wherein the mended warp is caught mechanically with a hooking member at a position in front of the dents.

6. A method of restoring a broken warp after mending the same according to claim 5, wherein the mended warp is moved together with a fabric being woven as the weaving operation progresses.

* * * * *